United States Patent [19]

Munie

[11] Patent Number: 4,940,420

[45] Date of Patent: Jul. 10, 1990

[54] ELECTRICAL CONNECTOR WITH RETAINED BOOT

[75] Inventor: Richard T. Munie, Dearborn Heights, Mich.

[73] Assignee: Ford Motor Company, Dearborn, Mich.

[21] Appl. No.: 394,903

[22] Filed: Aug. 17, 1989

[51] Int. Cl.[5] ..... H01R 13/52

[52] U.S. Cl. ..... 439/272; 439/271

[58] Field of Search ..... 439/271-283, 439/587, 556, 559

[56] References Cited

U.S. PATENT DOCUMENTS

| | | | |
|---|---|---|---|
| 3,685,004 | 8/1972 | Kerr | 439/281 |
| 4,311,355 | 1/1982 | Flyer et al. | 439/274 |
| 4,611,872 | 9/1986 | Ito et al. | 439/587 |
| 4,690,478 | 9/1987 | Rahrig et al. | 439/587 |

*Primary Examiner*—David Pirlot

*Attorney, Agent, or Firm*—Mark L. Mollon; Paul K. Godwin

[57] ABSTRACT

A sealed electrical connector includes one connector member having an oval-shaped cavity containing electrical contacts. A second connector member has a main body of a similar oval shape and having electrical contacts for mating with the contacts in the other connector member. A circular sealing boot is inserted into the cavity so as to deform to the oval shape, thereby providing lateral forces against the cavity wall which ensures that the sealing boot is retained in the cavity and promotes a tight seal when the main body of the second connector member is inserted into the cavity. The sealing boot is formed with elastomeric material into a circular cylindrical shape and is retained in the cavity even when the connector is disconnected.

7 Claims, 2 Drawing Sheets

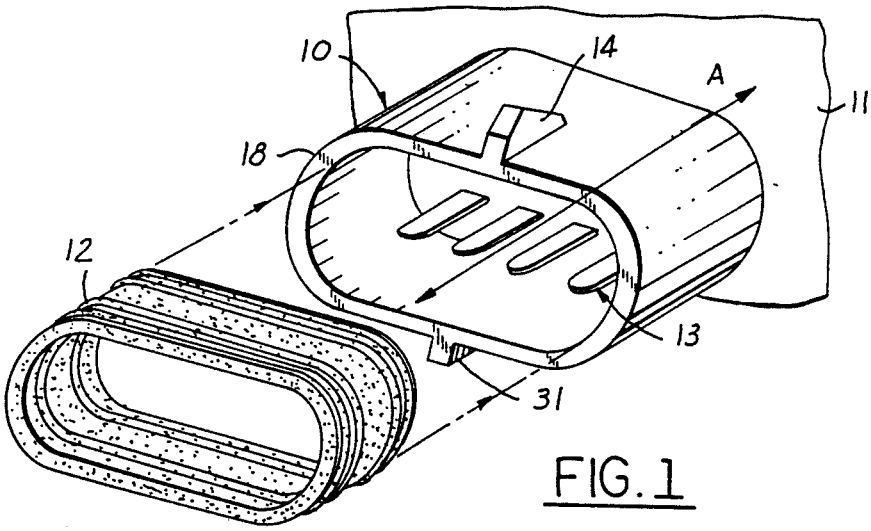
FIG. 1
FIG. 3
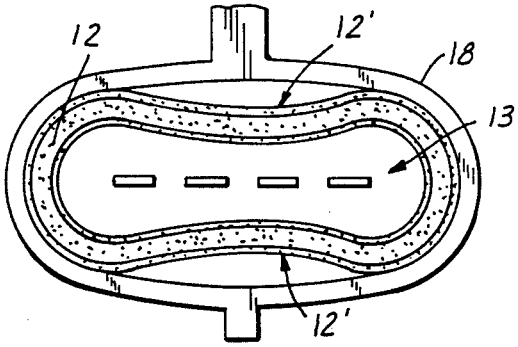
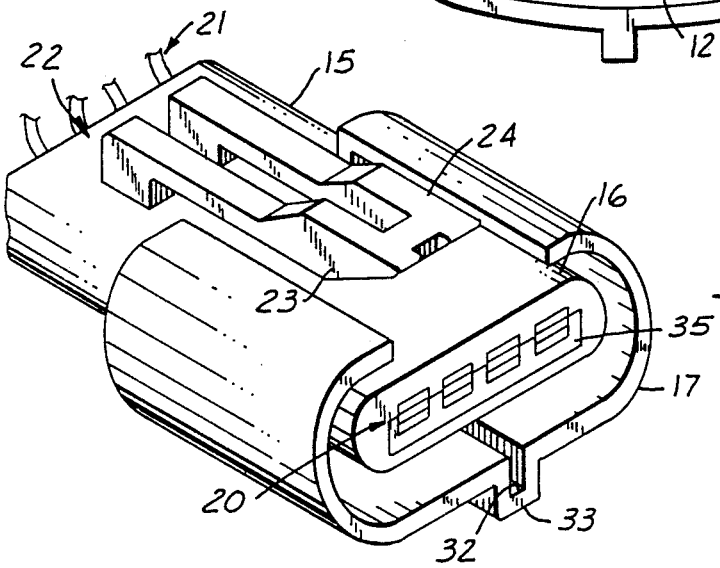
FIG. 2

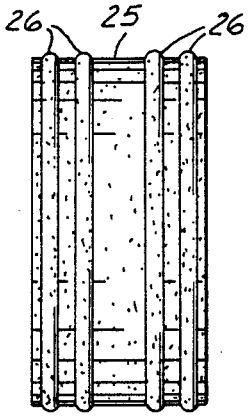
FIG.4
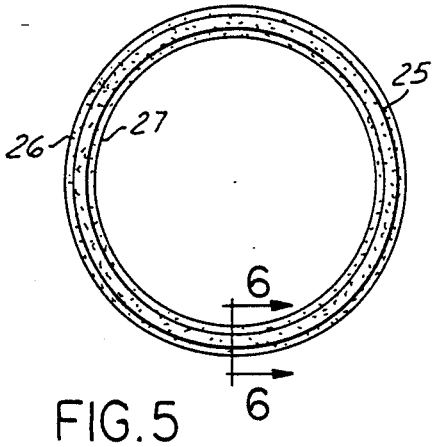
FIG.5
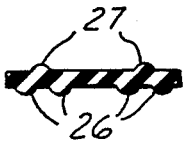
FIG.6
FIG.7
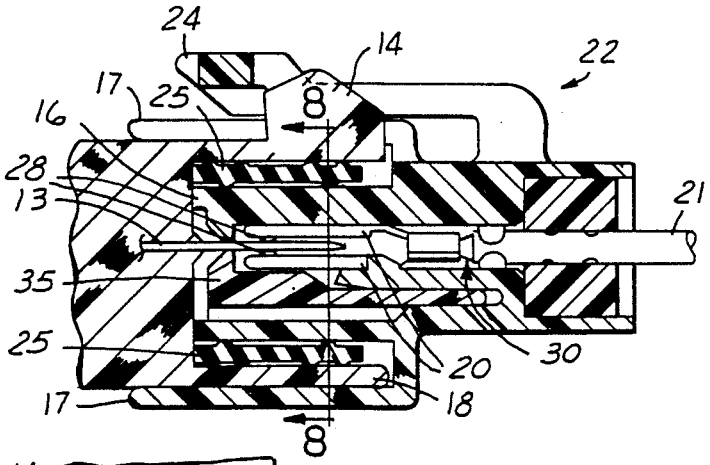
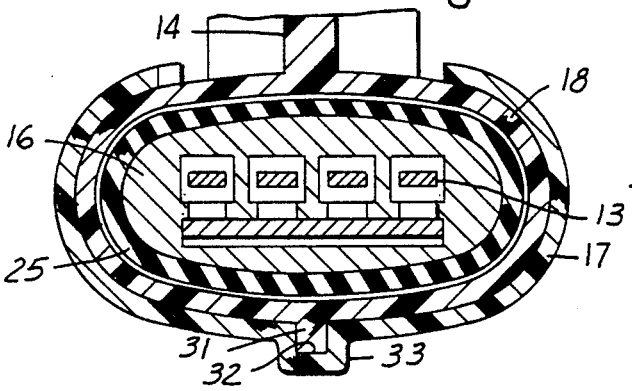
FIG.8

ELECTRICAL CONNECTOR WITH RETAINED BOOT

BACKGROUND OF THE INVENTION

The present invention relates in general to an electrical connector of substantially oval shape and more specifically to a submersible connector which is relatively simple and inexpensive to manufacture and which provides a reliable seal.

Electrical connectors of various shapes and sizes are employed in the electrical arts, each having its own advantages and disadvantages in different situations. To provide a connection to a printed circuit board having pins projecting from the edge of and parallel with a printed circuit board, an oval-shaped connector can be used in which the pins pass directly from the board into the connector.

Since the pins projecting from the circuit board will be in a straight row, the connector is configured to have an elongated cross-sectional shape. In applications where it is desired that the connector be submersible, any corners or discontinuities in the mating contours of the plug and socket connectors are avoided in order to be able to obtain a good seal. Thus, an oval or similar shape is desirable.

One technique used in manufacturing large volumes of electrical devices with sealed electrical connectors involves the placement of an oval sealing boot into an oval-shaped cavity in one part of the connector. The other half of the connector is then inserted inside the boot to establish both an electrical connection and a fluid seal at one time.

Since the assembly of a connector may involve separate steps performed in separate locations, e.g., an assemby line manufacturing process, it is desirable that the sealing boot tend to remain in place in the connector cavity prior to final interconnection, even in the presence of motion or vibration. It is also desirable for the boot to remain in place when a previously assembled connector is later disconnected.

The sealing boot is typically formed of elastomeric material, preferably silicon rubber. If the boot is too small, it will not be compressed by the cavity and will easily fall out. If the boot is too large, it will buckle in such a way that it will interfere with the electrical connection and it will not provide an adequate seal. In the manufacture of a large volume of parts, it is difficult and expensive to provide sealing boots having a size within the required tolerances, such that most boots do not either buckle or fall out of the connector.

SUMMARY OF THE INVENTION

Accordingly, it is a principal object of the present invention to provide a submersible connector which is not subject to the foregoing disadvantages.

It is another object of the invention to provide an oval-shaped electrical connector having a sealing boot wherein the sealing boot is retained within the connector cavity without buckling.

It is a further object of the invention to improve the performance and reduce the cost of submersible, oval-shaped connectors.

These and other objects are achieved by a sealed electrical connector having a first connector member, a second connector member, and a sealing boot, all oriented along a longitudinal axis. The first connector member has a front face, a plurality of first electrical contacts extending parallel with the longitudinal axis and meeting the front face, and a shroud extending from the front face annularly of the longitudinal axis. The inner circumference of the shroud has a substantially oval shape in cross-section perpendicular to the longitudinal axis. The sealing boot is received by the shroud. The sealing boot is formed to have a substantially circular cross-section perpendicular to the longitudinal axis and to have an outer circumference substantially equal to or slightly greater than the inner circumference of the shroud. The sealing boot is deformed by the shroud into a substantially oval shape in cross-section perpendicular to the longitudinal axis. The second connector member has a plurality of second electrical contacts extending parallel with the longitudinal axis and contacting the first electrical contacts. The second connector member has a substantially oval-shaped perimeter engaging the inner circumference of the sealing boot.

BRIEF DESCRIPTION OF THE DRAWINGS

The novel features of the invention are set forth with particularity in the appended claims. The invention itself, however, both as to its organization and method of operation, together with further objects and advantages thereof, may best be understood by reference to the following description taken in conjunction with the accompanying drawings, in which:

FIG. 1 is a perspective view showing an oval connector and an oval sealing boot.

FIG. 2 is a perspective view showing the remaining half of an oval connector.

FIG. 3 is a front view showing a buckled oval sealing boot in the connector of FIG. 1.

FIG. 4 is a side view of a circular sealing boot according to the present invention.

FIG. 5 is a front view of the circular sealing boot of the invention.

FIG. 6 is a cross-sectional view of the sealing boot along lines 6—6 of FIG. 5.

FIG. 7 is a side cross-sectional view along the middle of an assembled connector according to the present invention.

FIG. 8 is a transverse cross-section of a connector assembled according to the present invention taken along lines 8—8 of FIG. 7.

DETAILED DESCRIPTION OF PREFERRED EMBODIMENTS

Turning to FIG. 1, a receptacle connector member 10 projects from a device 11 which may include a printed circuit board (not shown). Receptacle member 10 includes a cavity defined by a shroud 18. An oval-shaped sealing boot 12 is sized for insertion into the cavity to be contiguous with the inner wall of shroud 18. A plurality of first electrical contacts 13 extend parallel to a longitudinal insertion axis A of the connector. In the embodiment shown in FIG. 1, the first electrical contacts 13 are comprised of male connector pins extending into the cavity and preferably extending back into electrical device 11 for contact to the printed circuit board (not shown).

FIG. 2 shows a plug connector member 15 for mating with receptacle member 10 after insertion of sealing boot 12 into the cavity. Plug member 15 includes a main body 16 having an outer perimeter surface sized to be insertable into sealing boot 12 while compressing sealing boot 12 to obtain a tight seal. Main body 16 includes a plurality of electrical contacts 20 extending parallel with longitudinal axis A. In the embodiment shown, electrical contacts 20 are comprised of female connector sockets which are connected internally of plug member 15 to respective electrical leads 21.

Plug member 15 further includes a sleeve 17 external of main body 16 for receiving shroud 18 (FIG. 1). Alignment of the plug and receptacle members during interconnection is obtained by means of a tab 31 projecting from shroud 18 (FIG. 1) which slides along a groove 32 in a dimple 33 of sleeve 17. Interlocking of the connector members at full insertion is achieved by means of a catch 14 on the exterior of shroud 18 (FIG. 1) which is grasped by the distal ends of a pair of fingers 22. Thus, distal ends 23 and 24 slide over catch 14 during connection and may be deflected over catch 14 during disconnection.

As previously mentioned, if the outside diameter of oval-shaped sealing boot 12 is too small (i.e., is less than the inside diameter of shroud 18), boot 12 will tend to fall out of receptacle member 10 during any movement. This is unacceptable both at the time of initial manufacture and subsequently during times that the connector is disassembled. If the outside diameter of sealing boot 12 is too large, i.e., excessively larger than the inside diameter of shroud 18, buckling of boot 12 occurs as shown in FIG. 3. Thus, boot 12 falls away from shroud 18 in areas 12' so that connection with plug member 15 does not occur with proper seating of boot 12. Boot 12 may interfere to prevent electrical connection of the electrical contacts and may also fail to provide sealing of the internal cavity.

According to the present invention, a circular cross section, cylindrically shaped sealing boot 25 is employed, as shown in FIGS. 4 and 5. Boot 25 preferably includes compressible ribs 26 on the outer circumference of boot 25. Boot 25 further includes interior compressible ribs 27 as shown in FIGS. 5 and 6.

A sealed connection can be established by employing the cylindrical sealing boot shown in FIGS. 4–6 in which the sealing boot has an outer circumference substantially equal to or slightly larger than the inner circumference of shroud 18 (FIG. 1). Preferably, the boot dimension is greater than the shroud dimension so that when boot 25 is inserted into shroud 18, the circumference of boot 25 is compressed by approximately one percent of its free state size (i.e., the shroud inner circumference equals about 99 percent of the boot outer circumference). The compression forces provide the retention of boot 25 in the connector.

Sealing boot 25 is inserted into the shroud so as to deform the sealing boot into a substantially oval shape. The circular cross-sectional boot exerts a larger lateral force against the shroud than the prior art oval-shaped boot. The plug member can then be inserted into the sealing boot and the shroud so as to join the electrical contacts and to establish a seal between the shroud and the perimeter of the plug member.

Turning now to FIG. 7, the connector of the present invention is shown in cross-section with the parts fully interconnected. Thus, a male terminal pin 13 is received between pads 28 on female terminal socket 20 which is connected by a crimped connection 30 to lead 21. Female terminal socket 20 is retained within main body 16 by the action of a retainer insert 35. Sealing boot 25 is compressed between the perimeter surface of main body 16 and the inner wall of shroud 18.

The assembly is locked in position by the action of sleeve 17 on one side of the connector and by the interlocking of catch 14 and fingers 22 on the other side of the connector. Distal end 24 is received on the rearward side of catch 14.

FIG. 8 shows the deformation of sealing boot 25 from its circular cross-section to an oval cross-section between shroud 18 and main body 16.

The foregoing connector configuration provides improved electrical performance while ensuring a better submersible seal. In addition, part cost is reduced due to the lesser complexity of manufacturing a circular or cylindrical sealing boot. Although a connector of one particular shape has been shown in the preferred embodiment, a substantially oval shape as described herein is intended to refer to any quasi-eliptical or other non-circular shape having smooth sides.

While preferred embodiments of the invention have been shown and described herein, it will be understood that such embodiments are provided by way of example only. Numerous variations, changes, and substitutions will occur to those skilled in the art without departing from the spirit of the invention. Accordingly, it is intended that the appended claims cover all such variations as fall within the spirit and scope of the invention.

What is claimed is:

1. A sealed electrical connector having a longitudinal insertion axis, comprising:

a first connector member having a front face, a plurality of first electrical contacts extending parallel to said longitudinal axis and meeting said front face, and a shroud extending from said front face annularly of said longitudinal axis, an inner wall of said shroud having a substantially oval shape as viewed in cross section perpendicular to said longitudinal axis;

a sealing boot received within said shroud, said sealing boot formed to have a substantially circular shape as viewed in cross section perpendicular to said longitudinal axis, said sealing boot having an outer cylindrical surface deformed by said shroud into a substantially oval shape conforming to said inner wall of said shroud; and a second connector member having a plurality of second electrical contacts extending parallel to said longitudinal axis and contacting said first electrical contacts, said second connector member having a substantially oval-shaped perimeter engaging an inner cylindrical surface of said sealing boot.

2. The connector of claim 1 wherein said first electrical contacts are comprised of male terminal pins extending from said front face and wherein said second electrical contacts are comprised of female terminal sockets located within said perimeter.

3. The connector of claim 1 wherein said sealing boot is substantially cylindrically shaped and includes a plurality of ribs.

4. The connector of claim 1 further comprising retaining means coupled to said connector members for retaining said connector members in a fully engaged position.

5. The connector of claim 1 wherein said sealing boot has an undeformed outer circumference substantially equal to or slightly greater than said inner circumference of said shroud.

6. The connector of claim 5 wherein said outer circumference of said sealing boot is substantially one percent greater than said inner circumference of said shroud.

7. A method of establishing a sealed connection in an electrical connector having a substantially oval-shaped cross section, said connector including a first connector member, a second connector member, and a sealing boot, said first connector member having a plurality of first electrical contacts and a shroud having a substantially oval-shaped inner wall annularly surrounding said first electrical contacts, said second connector member having a plurality of second electrical contacts and having a substantially oval-shaped perimeter for fitting within said inner wall of said shroud, said method comprising the steps of:

providing said sealing boot with a substantially circular cylindrical shape;

inserting said sealing boot into said shroud so as to deform said sealing boot into a substantially oval shape; and inserting said second connector member into said sealing boot and said shroud so as to join said first and second electrical contacts and to establish a seal between said shroud and said second connector member.

* * * * *